United States Patent [19]

Quiogue

[11] 4,405,974

[45] Sep. 20, 1983

[54] FILTER ASSEMBLY FOR LUMINAIRE

[75] Inventor: Honesto D. Quiogue, Blacksburg, Va.

[73] Assignee: Harvey Hubbell Incorporated, Orange, Conn.

[21] Appl. No.: 231,990

[22] Filed: Feb. 6, 1981

[51] Int. Cl.[3] ..... F21V 17/02

[52] U.S. Cl. ..... 362/362; 362/96; 362/294; 362/373; 362/375; 362/457

[58] Field of Search ..... 362/267, 293, 294, 373, 362/96, 362, 375, 457; 55/385 C, 385 F

[56] References Cited

U.S. PATENT DOCUMENTS

| | | | |
|---|---|---|---|
| 3,377,480 | 4/1968 | Robertson | 362/294 |
| 3,457,399 | 7/1969 | Milroy | 24/123 |
| 4,015,114 | 3/1977 | Paajanen et al. | 362/294 |
| 4,315,579 | 2/1982 | Martin, Jr. | 55/385 C |

*Primary Examiner*—Richard E. Schafer

*Assistant Examiner*—Ted L. Parr

*Attorney, Agent, or Firm*—Jerry M. Presson

[57] ABSTRACT

A filter assembly for a luminaire for preventing contaminants and impurities from entering the sealed enclosure of the luminaire while permitting air to pass into and out of the sealed enclosure. The filter assembly includes a fitting and a cap. The fitting has an axially extending passageway opening at its opposite ends and a cavity receiving an air-permeable filter across the passageway. The cap has a first portion coupled to the fitting to cover one end of the fitting passageway, a second portion extending laterally from the first portion and a solid back member extending over the first and second portions. The first and second portions and the back member define a non-linear passageway in fluid communication with the fitting passageway to permit air to flow into and out of the luminaire sealed enclosure through the filter, while protecting the filter from the elements.

12 Claims, 6 Drawing Figures

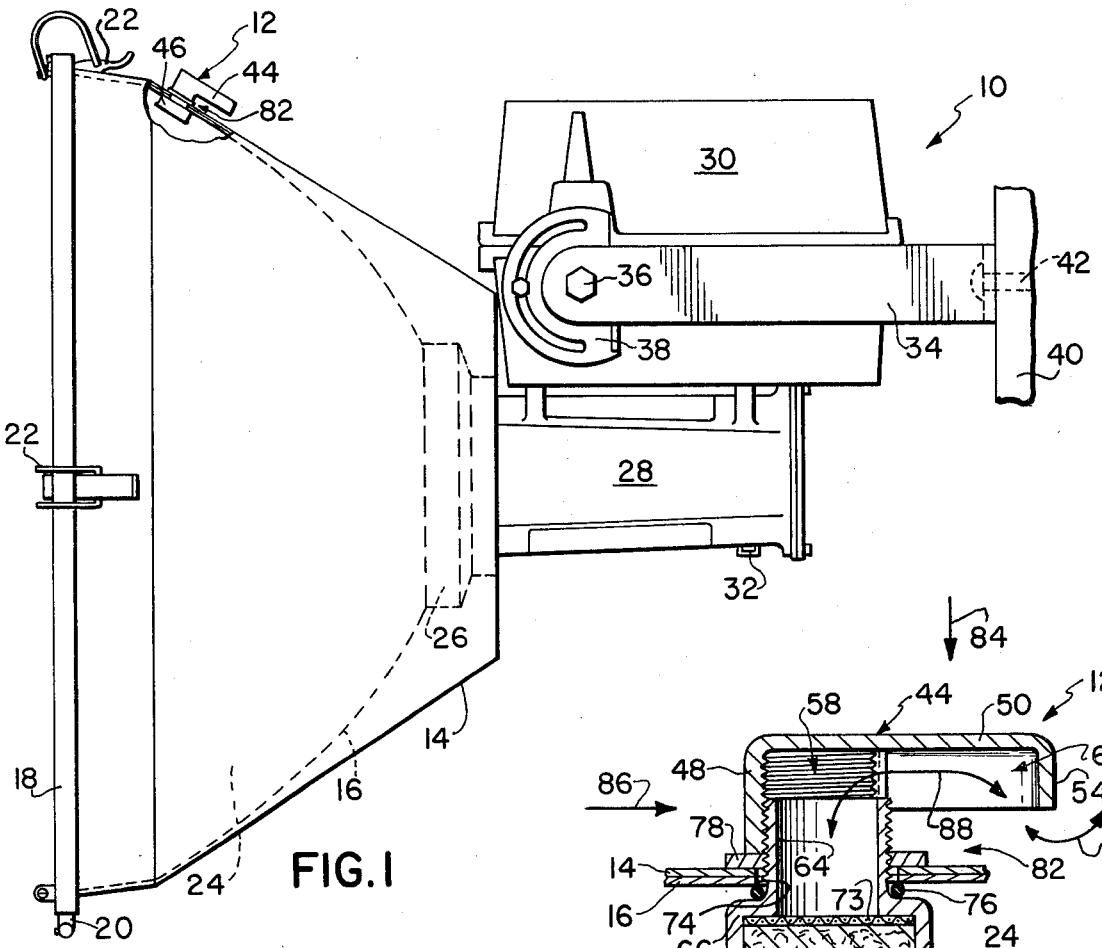
FIG.1
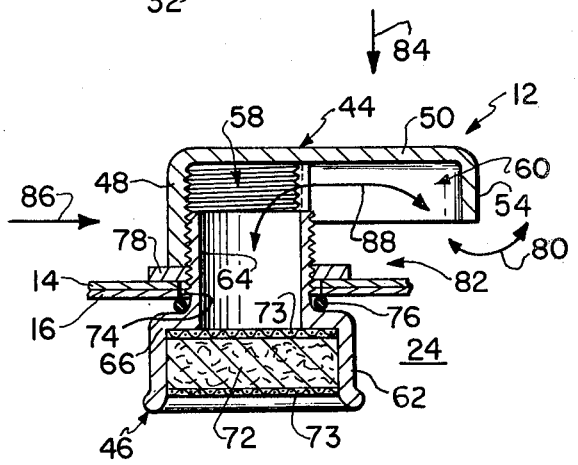
FIG.2
FIG.3
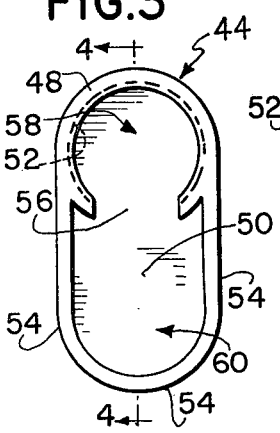
FIG.4
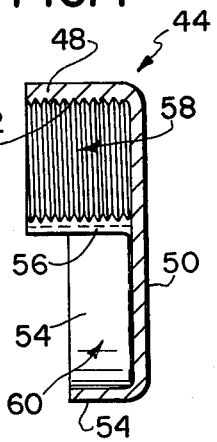
FIG.5
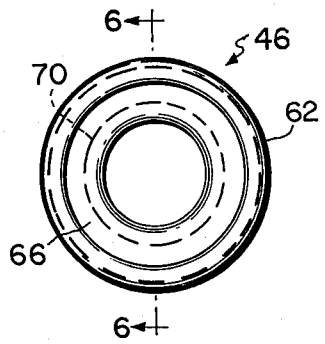
FIG.6
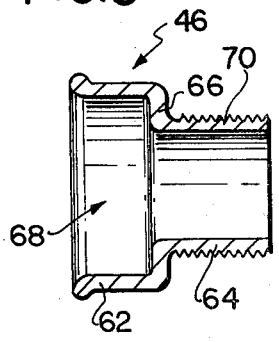

FILTER ASSEMBLY FOR LUMINAIRE

BACKGROUND OF THE INVENTION

1. Field of the Invention

This invention relates to a filter assembly for a luminaire, which assembly provides the sole passageway for air passage between the sealed enclosure and the exterior of the luminaire. More particularly, the present invention relates to providing a cap for the filter assembly that protects the filter from the elements and permits the filter assembly to be located in an exposed portion of the luminaire.

2. Description of the Prior Art

In high intensity discharge (HID) luminaires, such as those used for street lighting and industrial lighting in atmospheres containing impurities and contaminants, a sealed optical enclosure is desired. This sealing maintains the lighting power of the luminaire by keeping contaminants out of the system. For outdoor units, the sealing of the optical enclosure is particularly important to prevent rain and other elements and contaminants from entering the enclosure to avoid damage to and shorting of the electrical components of the luminaire.

Since sealed HID luminaires operate at relatively high temperatures, a pressure relief mechanism or breather is provided to let hot air escape during operation and to let air enter when the luminaire is turned off and permitted to cool. This pressure relief is necessary to alleviate the thermal stress which adversely affects the life of the lamp, the other electrical components in the luminaire and the glass lens.

Conventional pressure relief devices, such as that disclosed in U.S. Pat. No. 3,457,399 to Milroy, comprise a vent filled with a charcoal filter. The charcoal filter is air permeable, permitting hot air to escape from the sealed enclosure of the luminaire when the lamp is hot and cool air to enter into the sealed enclosure when the lamp cools. Since the filter is the sole air passageway to or from the sealed enclosure, the filter prevents impurities or contaminants from entering and building up in the sealed enclosure. By preventing contaminants from entering the sealed enclosure, such adverse effects on the luminating level of the optical system as dulling films, and corrosion and discoloring of the reflecting surface and glass lens are avoided.

In the outdoor luminaire embodiment disclosed in the Milroy patent, the filter assembly is located in a lower rear portion of the luminaire adjacent the ballast. The filter housing is a resilient tubular holder which is open at its opposite ends. The filter assembly is positioned within the luminaire housing adjacent the ballast to protect the filter assembly from the elements. In the industrial embodiment disclosed in the Milroy patent for indoor use, the filter assembly is located in an aperture in the reflector with its exterior surface exposed.

Conventional filter assemblies, such as that disclosed in the Milroy patent, are disadvantageous in that they can not be provided in the optimum location in the luminaire for the most efficient operation thereof and still be protected from the environment. For optimum effectiveness of the filter assembly, it should be located directly in the optical section at the upper part of the luminaire. However, for outdoor lighting, the filter assemblies have been located adjacent the ballast compartment at the bottom of the housing to prevent rainwater from getting into the housing through the charcoal filter assembly. Locating the filter assembly at the ballast compartment limits the aiming and placement of the luminaire with respect to mounting brackets or cross arms to the top mounting mode only.

SUMMARY OF THE INVENTION

It has now been discovered that a filter assembly for a luminaire should be provided with a mechanism that will effectively protect the filter assembly from the elements, such as rain. This mechanism is to be separate from the housing of the luminaire to permit placement of the filter assembly in any desired location in the luminaire to optimize operation of the filter and to facilitate mounting of the luminaire.

Accordingly, an object of the present invention is to provide a filter assembly for a luminaire which has an arrangement for effectively protecting the filter material from damage by the environment.

Another object of the present invention is to provide a filter assembly for a luminaire which may be located in an optimum position in the luminaire on its exposed surface.

A further object of the present invention is to provide a filter assembly which is of rugged construction and which is simple and inexpensive to manufacture, install and service.

The foregoing objects are obtained by a filter assembly for a luminaire comprising a fitting and cap. The fitting has an axially extending passageway opening at its opposite ends and a cavity receiving an air-permeable filter. The filter extends across the passageway in the fitting. The cap has a first portion coupled to the fitting to cover one end of the passageway and a second portion extending laterally from the first portion. A solid back member extends over the first and second portions. The first and second portions and the back member define a non-linear passageway in fluid communication with the fitting passageway.

By forming the filter assembly of the present invention in this manner, the cap protects the filter material from such elements as rain, snow and sleet, while permitting the passage of air into and out of the sealed enclosure of the luminaire. Since the filter assembly possesses its own arrangement for protecting it from the elements, it may be located on any exposed portion of the luminaire. It need not be located within the ballast or other electrical component housing or relative to the mounting structure for the luminaire to protect it from the elements. This permits the filter assembly to be optimally located adjacent the top of sealed enclosure.

The fitting and the cap may be rotatably coupled by a threaded connection. This coupling enables the cap to be adjusted relative to the mounting of the luminaire to optimize protection of the filter assembly.

The fitting can comprise a relatively large interior section and a relatively small exterior section. The sections are separated by a radially extending flange. The interior section defines the cavity for receiving the filter material. The radially extending flange, with such locking mechanisms as a lock nut, permit the fitting to be secured in an opening in the luminaire independently of the cap by gripping the portions of the luminaire adjacent the opening therein between the radially extending flange and the lock nut. By securing the fitting to the luminaire in this manner, the cap can be rotatably adjusted without adversely effecting the attachment of the filter assembly to the luminaire.

The cap is generally oblong with a first portion in the form of a cylinder depending from the back member. A lateral aperture is formed in the cylinder to provide full communication between the first and second portions of the cap. The second portion of the cap is defined by the cylinder and lateral walls depending from the back member with the non-linear passageway opening in a direction generally parallel to and towards the fitting and luminaire. This cap arrangement prevents rain or other environmental elements from entering the fitting passageway and damaging the filter material, while permitting the free flow of air through the filter assembly and into and out of the sealed enclosure.

Other objects, advantages and salient features of the present invention will become apparent from the following detailed description which, taken in conjunction with the annexed drawings, discloses a preferred embodiment of the present invention.

BRIEF DESCRIPTION OF THE DRAWINGS

Referring to the drawings which form a part of this original disclosure:

FIG. 1 is a side elevational view of a luminaire with a filter assembly in accordance with the present invention;

FIG. 2 is an enlarged side elevational view, in longitudinal section, of the filter assembly of FIG. 1;

FIG. 3 is a bottom plan view of the cap of FIG. 2;

FIG. 4 is a side elevational view of the cap in longitudinal section taken along line 4—4 of FIG. 3;

FIG. 5 is a bottom plan view of the fitting of FIG. 2; and

FIG. 6 is a side elevational view of the fitting in longitudinal section taken along line 6—6 in FIG. 5.

DETAILED DESCRIPTION OF THE PREFERRED EMBODIMENT OF THE INVENTION

Referring to FIG. 1, a luminaire 10 is shown with a filter assembly 12 in accordance with the present invention. Luminaire 10 comprises an aluminum hull or housing 14 in which a reflector 16 is attached. The front face of housing 14 is closed by a heat and impact resistant tempered glass lens. The lens is attached to housing 14 by a stainless steel door band 18 that is hinged at 20 to housing 14. A water-tight gasket can be provided between the lens and the housing to insure a water-tight seal therebetween. Door band 18 is pressed against the outer surface of the lens and is locked in position by spring loaded, snap latches 22. The lens and reflector 16 define a sealed enclosure 24 in which the socket or lamp coupling 26 is mounted.

Attached to the rear end of housing 14 is socket housing 28 which includes a wiring compartment therein. A ballast housing 30 is mounted above socket housing 28. A water-tight cable entry bushing 32 is provided at the bottom of socket housing 28. A generally U-shaped steel trunnion 34 is hingedly coupled to ballast housing 30 by lock bolts 36. A calibrated aiming and repositioning stop 38 is coupled to trunnion 34 to facilitate aiming and repositioning of luminaire 10 relative to support 40. Bolts 42 secure trunnion 34 to support 40.

Filter assembly 12 comprises two main parts, cap 44 and fitting 46. Cap 44 is mounted exteriorly of luminaire housing 14. Fitting 46 has a portion located within sealed enclosure 24 and a portion extending outwardly therefrom to the exterior of housing 14 for coupling to cap 44. The details of cap 44 and fitting 46 and of their attachment to luminaire 10 are illustrated in FIGS. 2–6.

Cap 44 is generally oblong in plan view. As illustrated in FIGS. 3 and 4, cap 44 includes an upper or first portion 58 formed as a partial cylinder 48 extending from a solid back wall or member 50. Internal threads 52 are formed on the interior surface of cylinder 48. A lower or second portion 60 of cap 44 extends laterally from cylinder 48 and is defined by cylinder 48 and by lateral walls 54 extending from the lower peripheral portion of back wall 50 in the same direction as cylinder 48. Lateral walls 54 extend from back member 50 to a lesser extent than cylinder 48. A lateral opening or slot 56 is formed in cylinder 48 to provide fluid communication between the first portion 58 and the second portion 60 of cap 44.

Fitting 46, illustrated in FIGS. 5 and 6, comprises interior and exterior cylindrical sections 62, 64 coupled end to end along a single axis, i.e., coaxially. Sections 62, 64 are separated and joined by a radially extending flange 66 which is generally annular in shape. The interior surface of section 62 defines a cavity 68. The external surface of exterior section 64 has male threads 70 formed thereon. Cavity 68 and the internal surface of exterior section 64 define a through passageway in fitting 46.

The complete assembly of filter assembly 12 in a luminaire is illustrated in FIG. 2. Suitable air-permeable filter material 72, such as activated charcoal particles in powder or granular form, is secured in cavity 68 in interior section 62 of fitting 46 by disc-shaped wire screens 73. Screens 73 are located on opposite sides of filter material 72 and are secured to fitting 46 by an interference fit between interior cylindrical section 62 and the peripheries of the screens. The screens can be 1/16 inch larger than the internal diameter of section 62 to provide such interference fit. The screens 73 can be 28 mesh and can be formed of 0.018 inch diameter, 300 series stainless steel wire.

Fitting 46 is mounted in an opening 74 formed in housing 14 and reflector 16 with its interior section 62 located within sealed enclosure 24. A sealing ring or gasket 76 is mounted adjacent radial flange 66 on exterior section 64, which section extends through opening 74, to prevent the passage of air around fitting 46 instead of through fitting 46. A lock nut 78 is threaded on threads 70 to entrap those portions of housing 14 and reflector 16 which are adjacent opening 74 between lock nut 78 and flange 66 to secure fitting 46 within opening 74. In this manner, interior section 62 will be located within sealed enclosure 24 and exterior section 64 will extend through opening 74 to the exterior of housing 14.

Once fitting 46 is secured in opening 74, cap 44 is rotatably coupled to fitting 46 by engagement of threads 52 on cylinder 48 and threads 70 on exterior section 64. Cap 44 is theaded all the way down on fitting 46 so as to provide a tight connection therewith. Thereafter, cap 44 is rotated as desired to provide optimum protection against rain by orienting cylinder 48 such that it faces generally in the direction of the rain. In this position, the distance between the free end of fitting exterior portion 64 and cap back wall 50 is less than the extension of lateral walls 54 from back wall 50 so that these walls extend beyond the free end of exterior portion 64 to protect it from rain.

Since the remaining portions of sealed enclosure 24 are air-tight, filter assembly 12 provides the sole passageway for air to pass between sealed enclosure 24 and the exterior of luminaire 10. The air passageway through filter assembly 12 is non-linear and is depicted by arrows 80, 88. During operation of the lamp, hot air is expelled from sealed enclosure 24 through filter 72, through the interior of exterior portion 64, and into first portion 58 of cap 44 defined by cylinder 48. From first portion 58, the hot air passes through lateral opening 56 in cylinder 48 and into second portion 60 of cap 44 defined by lateral walls 54, solid back wall 50 and cylinder 48. Second portion 60 opens in a direction toward fitting 46 and housing 14. Since cylinder 48 extends from back wall 50 to a greater extent than the lateral walls 54, a gap 82 is formed between the free ends of walls 54 and housing 14 to permit the hot air to escape to the atmosphere.

When the lamp of luminaire 19 is turned off and cools, air passes into sealed enclosure 24 along a path opposite that described for the expulsion of hot air. The incoming air passes through filter material 72 to trap impurities and contaminants and to prevent such impurities and contaminants from entering sealed enclosure 24 and adversely effecting the candlelight power of luminaire 10 and the components thereof.

By arranging filter assembly 12 of the present invention in this manner, filter material 72 is fully protected from environmental elements, such as rain, snow and sleet by the non-linear air passageway formed by fitting 46 and cap 44. Back wall 50 prevents entry of rain along a line generally indicated by arrow 84. Cylinder 48 is oriented generally in the direction of the rain to prevent entry of rain into filter assembly 12 along directions generally indicated by arrow 86. Cap 44 and fitting 46 combine to prevent entry of rain in directions between those indicated by arrows 84, 86. Gap 82 between cap 44 and luminaire housing 14 provides a relatively narrow space which is obstructed from direct access to filter material 72 by a non-linear passageway. This effectively prevents rain from contacting filter material 72, while freely permitting the flow of air to and from sealed enclosure 24 through filter material 72.

The luminaire 10 illustrated in the drawings and described hereinabove, is only one example of the type of luminaire with which the filter assembly of the present invention may be used. Filter assembly 12 may be employed with almost any type of indoor or outdoor luminaire due to the universal nature of its construction. For outdoor lighting, the present invention is especially effective in preventing damage caused by rain, snow or sleet. For indoor luminaires, filter assembly 12 will prevent damage to filter material 72 by preventing industrial materials floating or drying in the air from impacting and damaging filter material 72 and from covering and blocking the air passageway to filter material.

While various embodiments have been chosen to illustrate the invention, it will be understood by those skilled in this art that various changes can be made therein without departing from the scope of the invention as defined in the appended claims.

I claim:

1. A filter assembly for a luminaire, comprising:

a fitting having an axially extending passageway opening at opposite ends thereof and a cavity receiving an air-permeable filter across said passageway; and an elongated cap having a first portion coupled to said fitting to cover one end of said fitting passageway, a second portion extending laterally from said first portion and a solid back member extending over said first and second portions, said portions and back member defining a non-linear passageway in fluid communication with said fitting passageway, said fitting and cap being rotatably coupled, said first portion having a cylinder depending from said back member and a lateral slot communicating with said second portion, and said second portion being defined by said cylinder and lateral walls depending from said back member with said non-linear passageway opening in a direction generally parallel to and towards said fitting, said lateral walls extending from said back member to a lesser extent than said cylinder;

whereby, said cap can be adjustably positioned on the luminaire to maximize protection of said filter against damage from environmental conditions.

2. A filter assembly according to claim 1, wherein said fitting and cap are threadedly coupled.

3. A filter assembly according to claim 1, wherein said fitting comprises interior and exterior sections coaxially coupled by a radially extending flange.

4. A filter assembly according to claim 3, wherein said interior section has greater transverse dimensions than said exterior section; and said cavity is formed in said interior section.

5. A filter assembly according to claim 1, wherein said fitting has means for securing said fitting to a luminaire.

6. A luminaire, comprising:

a housing having a sealed optical enclosure;

a lamp coupling mounted in said sealed enclosure; and a filter assembly mounted in an opening in said housing forming the sole passageway for air to pass between said sealed enclosure and the exterior of the luminaire, said filter assembly including a fitting mounted in said opening and having an axially extending passageway opening at an interior end in said sealed enclosure and at an exterior end exteriorily of the luminaire, an air-permeable filter secured in said fitting across said fitting passageway, and an elongated cap having a first portion coupled to and covering said exterior end of said passageway, a second portion extending laterally from said first portion and a solid back member extending over said first and second portions, said portions and back member defining a non-linear passageway in fluid communication with said fitting passageway and opening in a direction facing said housing, said fitting and cap being rotatably coupled, said first portion having a cylinder depending from said back member and a lateral slot communicating with said second portion, and said second portion being defined by said cylinder and lateral walls depending from said back member with said non-linear passageway opening in a direction generally parallel to and towards said fitting, said lateral walls extending from said back member to a lesser extent than said cylinder;

whereby, said cap can be adjustably positioned relative to said housing to maximize protection of said filter against damage from environmental conditions.

7. A luminaire according to claim 6, wherein said filter assembly is located at the top of said sealed enclosure.

8. A luminaire according to claim 6, wherein said fitting is secured in said opening independently of said cap.

9. A luminaire according to claim 6, wherein said fitting comprises interior and exterior sections coaxially arranged and located interiorly and exteriorly, respectively, of said housing.

10. A luminaire according to claim 9, wherein said interior section has greater transverse dimensions than said exterior section.

11. A luminaire according to claim 10, wherein said filter is housed in said interior section.

12. A luminaire according to claim 9, wherein said filter is housed in said interior section.

* * * * *